US011431121B2

(12) United States Patent
Van Nierop et al.

(10) Patent No.: US 11,431,121 B2
(45) Date of Patent: Aug. 30, 2022

(54) INTERPOSER/ELECTRICAL CONNECTOR

(71) Applicants: GKN Aerospace Services Limited, Redditch (GB); Fokker Aerostructures BV, Hoogeven (NL)

(72) Inventors: Jasper Van Nierop, Hoogeven (NL); Louk Barents, Hoogeven (NL); Erik Groen, Hoogeven (NL); Ashley Brooks, Redditch (GB); Stephen Goodfellow-Jones, Redditch (GB)

(73) Assignees: GKN Aerospace Services Limited, Redditch-Worcestershire (GB); Fokker Aerostructures BV, Hoogeven (NL)

( * ) Notice: Subject to any disclaimer, the term of this patent is extended or adjusted under 35 U.S.C. 154(b) by 0 days.

(21) Appl. No.: 17/049,150

(22) PCT Filed: Apr. 23, 2019

(86) PCT No.: PCT/EP2019/060334
§ 371 (c)(1),
(2) Date: Oct. 20, 2020

(87) PCT Pub. No.: WO2019/206886
PCT Pub. Date: Oct. 31, 2019

(65) Prior Publication Data

US 2021/0242619 A1 Aug. 5, 2021

(30) Foreign Application Priority Data

Apr. 23, 2018 (GB) ..... 1806590

(51) Int. Cl.
*H01R 13/41* (2006.01)
*H01R 13/24* (2006.01)
*H01R 13/52* (2006.01)

(52) U.S. Cl.
CPC ..... *H01R 13/41* (2013.01); *H01R 13/2471* (2013.01); *H01R 13/521* (2013.01)

(58) Field of Classification Search
CPC ... H01R 13/41; H01R 13/521; H01R 13/2471
See application file for complete search history.

(56) References Cited

U.S. PATENT DOCUMENTS 6,773,283 B2 * 8/2004 Yoshimatsu ..... H01R 12/714 439/180
2002/0013079 A1 1/2002 Yoshimatsu et al.
2016/0105929 A1 4/2016 Spalding, Jr.

FOREIGN PATENT DOCUMENTS

DE 10048763 A1 4/2002

OTHER PUBLICATIONS

International Search Report and Written Opinion for PCT/EP2019/060334 dated Jul. 1, 2019 (12 pages).

* cited by examiner

*Primary Examiner* — Briggitte R. Hammond
(74) *Attorney, Agent, or Firm* — Bejin Bieneman PLC

(57) ABSTRACT

An electrical coupling for aerospace applications comprises an interposer arranged in use to electrically connect an electrical connector to an electrical circuit, the electrical connector comprising a plurality of electrical contacts and the electrical circuit comprising a plurality of electrical conductors. The interposer comprises a body arranged to surround each electrical contact within the connector.

19 Claims, 6 Drawing Sheets

INTERPOSER/ELECTRICAL CONNECTOR

CROSS-REFERENCE TO RELATED APPLICATIONS

This application is a national stage of, and claims priority to, Patent Cooperation Treaty Application No. PCT/EP2019/060334, filed on Apr. 23, 2019, which application claims priority to Great Britain Application No. GB1806590.4, filed on Apr. 23, 2018, which applications are hereby incorporated herein by reference in their entireties.

BACKGROUND

When an aircraft is in flight, ice can build up on the wings of the aircraft due to the high altitude (resulting in extremely low temperatures) and moisture in the air. This ice is undesirable as it affects the aerodynamic structure of the wing and thus has a significant effect on the aerodynamic lift provided by the wing.

De-icing systems are commonly used which act to remove ice from the wing of an aircraft before the ice builds up to a level at which it has a serious effect on the flight of the aircraft. This can be achieved by directing hot engine exhaust gases to the leading edges of the wings or by electrically heating the aircraft surfaces. Electrical solutions involve integration of conductive elements under the leading edge surface of the wing to directly heat the surface of the wing and prevent the ice from accumulating. These are electrically connected to generators in the engine which generate the necessary current. The electrical wiring can be installed in the aircraft during the manufacture of the wing.

Conventional electrical heating systems have provided a good solution to prevent ice build-up in aerospace applications. However, the requirement for an electrical circuit presents complications, particularly for maintenance and for aircraft which regularly fly through turbulence.

Maintenance is required to electrical ice protection systems and may involve removing/replacing all or part of the heating circuits. Thus, the electrical connections to the generators must be broken and remade. In use significant vibrations in flight can put mechanical loads onto electrical connection causing connections to weaken and fail.

There are additional complications with sealing of electrical connections, particularly in the harsh environment around and within the wing. Melting ice also creates water ingress issues which can cause electrical connections to fail. Similarly water which may have penetrated the ice-protection system can then freeze causing internal mechanical loading as the ice expands again leading to protection electrical connection problems.

SUMMARY

The present disclosure describes electrical connector systems for use in aerospace applications, and a method of manufacturing the same, e.g., for application to a leading edge of a wing of an aircraft where electrical circuits are deployed to heat the wing surface. Moreover, as will be recognised from the disclosure herein that the other applications are possible where it is desirable to provide an environmental seal between electrical contacts and an electrically conductive surface.

Herein described is a way to provide an environmentally sealed interconnection to, for example, PCBs that are fitted in harsh aerospace environments such as on the leading edge of the wing of an aircraft. In these environments, there is a risk of moisture ingress as a result of e.g. humidity and altitude cycling. The present disclosure provides a sealed electrical connection to prevent the moisture ingress reaching the electrical connection.

The disclosure provides a system which allows for quick and simple assembly of electronic components in aerospace applications. Further included is an interposer which can be adapted to fit multiple integration needs such as, for example, structurally integrated terminations and flexible PCBs and fit on various connector interfaces.

Thus provided is a standardised solution which is not only suitable for the leading edge of an aircraft wing but is also suitable for use in other aerospace applications. Furthermore, the present concept can be used anywhere it is desired to make connection onto a conductive surface, not just a PCB.

Viewed from a first aspect there is provided an electrical coupling for aerospace applications, the coupling comprising an interposer arranged in use to electrically connect an electrical connector to an electrical circuit. The electrical connector comprises a plurality of electrical contacts and the electrical circuit comprises a plurality of electrical conductors. The interposer comprises a body arranged to surround each electrical contact at a portion of the body proximate in use to the electrical conductors, said body comprising a plurality of ducts each arranged around an electrical contact and configured to extend from the body along at least part of the length of each contact towards the electrical connector.

Thus, a coupling is provided which comprises an internal interposer which encases or surrounds each of the electrical contacts within a connector. Conventionally an electrical connection is made by mating a connector plug with an associated receptacle wherein a plurality of electric pin or socket contacts are provided which can electrically connect with associated pin or socket contacts in the opposing connector. In turn the electrical path passes through the connector contacts to the electrical circuit or conductor which generates the heat (in for example an anti-icing system).

In an implementation described herein a bespoke interposer is arranged which extends from a part of the coupling proximate the electrical conductors towards the electrical connector in the form of a plurality of ducts or 'chimneys'. Each duct is advantageously arranged to closely surround each of the contacts and to extend along each contact towards the connector.

The connector itself may for example be a standard, off-the shelf connector and the interposer ducts may be adapted to fit securely within the standard connector. Thus, the present disclosure may be applied to existing industry compliant connectors.

The term interposer is intended to refer to an internal component of an electrical connector that allows for one or more electrical paths to be provided from an input to an output of the coupling. The interposer described herein provides an electrical path through a plurality of conductive contacts from an electrical supply to a series of electrical conductors (for example electrical tracks) that form part of the heating circuit (in one example use) for an anti-icing system for aerospace applications.

The interposer is designed to support and contain the electrical contacts as well as allow for mechanical, thermal and other environmental conditions whilst maintaining an electrical contact.

The interposer may be formed of independent and discrete components all adjacent to each other. For example each duct may be an independent component. However, advantageously the body and ducts may be integral with each other. Thus a single continuous component may be provided which may for example be injection moulded. A continuous body of the interposer allows the interposer to also act as a seal preventing movement of water or other liquids or sand, dust or other contaminations through the interposer. This shields the contacts from any adverse environmental conditions or unwanted particles.

Furthermore, integrating the ducts and a base of the interposer provides structural support for each of the ducts relative to the base. This allows for easier installation of the ducts around the contacts or easier installation of the contacts in the ducts.

The contacts may each be provided with a suitable length to extend from the upper connector to the electrical conductors forming (in one example) part of the heater circuit. The contact may simply be arranged to abut with the electrical conductor circuit.

However, each electrical contact may comprise a biasing arrangement at a portion of the contact proximate in use to the electrical conductors, arranged to bias a distal end of the contact against a respective electrical conductor. The end of the contact proximate to the electrical conductor may therefore be biased against the conductor surface to ensure a constant electrical contact between the contact and the conductor. Advantageously biasing the contact against the conductor allows the connection to accommodate thermal expansion and other relative movement. Thus, adverse and changing flight conditions can be accommodated by the coupling within the environment of the wing.

The biasing may be achieved in different ways. In one arrangement the biasing arrangement may be in the form of a spring arranged to bias a distal portion of the contact towards a respective conductor.

The electrical contact and the surrounding ducting may be any suitable shape i.e. cross-sectional shape. In one arrangement the contact may be circular in cross-section and the associated duct tubular in cross-section. Thus, the contact can move conveniently within the duct.

Furthermore, the inner surfaces of the ducts may be in contact with the outer surface of the contacts to restrict movement of the contacts if needed. Additionally the contact can be structurally supported by the duct which may allow the contact to be smaller (a smaller outside diameter) than would ordinarily be needed. In effect the duct may provide the structural support and the contact the electrical connection.

In an arrangement where a biasing arrangement is used the length of each contact may be longer than the distance measured between a portion of the electrical connector associated with a proximal portion of a respective contact and a surface of an electrical conductor associated with a distal portion of the same contact. Making the contact slightly longer than the distance between the electrical connector/plug and the electrical conductors ensures that the biasing arrangement is compressed and therefore the contact biased against the conductor surface.

The interposer may be formed from any suitable material. Advantageously the interposer may be formed from a thermo-set or a thermoplastic material. For example, an electrical insulator such as PEEK may be used.

The interposer may also be provided with a peripheral wall or layer surrounding and spaced from the ducts, wherein the wall extends in a direction parallel with the ducts. In effect a perimeter ring is provided surrounding the duct which may be conveniently used to connect the interposer to the connector.

Such a peripheral wall or ring may advantageously be spaced, radially, from the ducts. This then defines a radial space between the ducts and the wall which can receive a portion of the electrical connector. For example, part of the electrical connector can be positioned into the space and the outside of the interposer (surrounding the wall) may then be provided with a compression ring or the like to tightly secure the interposer body and connector together. It also provides a further convenient seal to prevent ingress of water or the like into the connector. Still further, by selecting a flexible material for the interposer (and optionally the electrical connector) vibrations and thermal changes can easily be accommodated.

The electrical connector connecting the electrical supply to the coupling may be any suitable connector. Advantageously the connector may be any suitable aerospace industry standardized connector, for example MIL-DTL-38999.

The interposer may also be provided with one or more additional seals to prevent passage of liquid, sand, dust or other contaminants through the coupling. For example, the interposer may comprise a seal layer provided with a plurality of apertures each aperture aligning with a respective contact and wherein the seal layer is located at a portion of the body proximate in use to the electrical conductors. The seal may be arranged so as to surround each contact and duct and to provide a peripheral seal surrounding the biasing arrangement. Thus, each contact and duct may be independently sealed.

The coupling may further comprise an end cap arranged to connect the end of the coupling and to define a cavity into which electrical conductors may extend. In effect the cap is located on an end of the coupling distal from the electrical connector and provides a void or space into which the electrical circuit or conductors can extend and make contact with the ends of the contacts. This cap may be connected by means of a snap-fit connection or one or more screwed and nuts for example.

The cap may itself comprise one or more seal layers to further protect the electrical contact and conductors. For example, the end cap may further comprise a seal layer arranged in use to abut with a side of an electrical conductor layer opposite to the side against which the contacts abut. In effect the conductors are then sandwiched between two seals—one surrounding each of the contacts and ducts and another positioned on the opposing side of the conductor or layer containing or supporting the conductor(s).

Viewed from another aspect there is provided an electrical coupling for aerospace applications, the coupling comprising a body configured to be integrated with a surface having a plurality of ducts arranged in use to align with corresponding connections of an electrical connector at a first end and to align with a plurality of electrical conductors at a second end wherein the conductors are integrated with the surface, the ducts extending through the body, wherein each duct comprises an electrical contact, each electrical contact comprising a biasing arrangement at a portion of the contact proximate in use to the electrical conductors, to bias a distal end of the contact against a respective electrical conductor.

In the present example, the term "integrated" is intended to mean that the electrical conductors are incorporated inside a surface of the structure as opposed to on a surface. For example, the electrical conductors may be inside the surface of the leading edge of an aircraft wing. Thus when the electrical coupling is in use and the contacts are arranged to align with the electrical terminals of a functional device, it is integrated with the composite structure, for example, the leading edge of the wing. This provides a secure and sealed connection between the contacts and the electrical terminals within the structural loading envelope of the wing, and prevents the ingress of contaminants or liquids.

As described herein the biasing arrangement may be in the form of a spring arranged to bias a distal portion of the contact towards a respective conductor.

The housing or body forming the outside of such an electrical connector may advantageously comprise a face (proximate in use to the electrical conductors) which is convex in profile corresponding to a predetermined curvature i.e. the surface bulges out and away from the normal housing surface. This face may be selected so as to correspond, for example, to the curvature of an aerodynamic part of the plane wing such as the leading edge (as just one example).

The housing or body of the connector may also be provided with a peripheral flange extending from the body for attachment to a surface in aerospace applications. Advantageously the peripheral flange may also have a curvature corresponding to the aerospace surface, for example the leading edge of a wing of an aircraft. This allows the housing or body to be conveniently aligned with the surface of the aircraft structure.

The housing or body may be formed of any suitable material. Advantageously the flange and body/housing may be formed from a composite laminate non-conductive material such as, for example, glass reinforced plastics. Components are typically manufactured by laying up a plurality of resin infused layers to form the desired shape. According to an implementation described herein a flange can be incorporated onto or between adjacent layers in such a composite stack and fully integrated into the surface by co-curing the flange (and optionally housing/body) with the aerospace surface. This may be out-of-autoclave curing or curing by means of a heated autoclave.

Thus, an electrical connector for an anti-icing system (in one example) may be simultaneously manufactured or formed during the forming of a curved leading edge component. A robust and secure electrical connection can then be integrally provided for the component. In other examples, the leading edge structure and electrical connector may be manufactured separately and later joined together to form an integrated structure.

An example material for an aircraft leading edge is a composite material of epoxy with a woven-glass reinforcement material, with a bonded metallic erosion shield.

In a still further aspect described herein there is provided an anti-icing system for aerospace applications comprising an electrical circuit arranged to conduct heat to a surface and an electrical connector arranged to electrically couple an electrical supply to the electrical circuit, said electrical connector comprising an interposer arranged in use to electrically connect the electrical supply and the electrical circuit, the interposer comprising a body arranged to surround at least one electrical contact at a portion of the body proximate in use to the electrical circuit, said body comprising a plurality of ducts each arranged around an electrical contact and configured to extend from the body along at least part of the length of each contact towards the electrical connector.

In such an arrangement the electrical connector may comprise a housing with a plurality of apertures through which the electrical contacts extend, the contacts arranged in use to electrically couple with an electrical supply at a first end and with one or more electrical circuits at an opposing end wherein the one or more electrical circuits are integrated with the aircraft surface and wherein the housing comprises a peripheral flange extending radially from the housing.

The intended meaning of the term "integrated" is discussed above.

A modified coupling incorporating an interposer as described herein provides a number of technical advantages including:

- The interposer allows standard aerospace electrical connectors to be terminated to termination pads or islands (or tracks) such as on e.g. a printed circuit boards (PCBs)
- The biasing or spring loaded contacts allow for the following to be guaranteed:
  - (i) Contact suspension (to prevent contact fretting during high vibration exposure);
  - (ii) Contact alignment (tolerates contact misalignments as a result of dimensional tolerances between the conductors, connector and mating connector; and
  - (iii) Termination stress relief (prevents excessive stress build-up in the actual termination between PCB and contact as a result of, for example, thermal expansion.

The interposer arrangement is highly versatile and can be customised. It advantageously houses the contact safely, provides environmental sealing, provides electrical insulation and (if needed) allows for the integration of the fixation method to install the assembly in its intended application.

SUMMARY OF THE DRAWINGS

Aspects of the disclosure will now be described, by way of example only, with reference to the accompanying figures in which.

Figure 1:
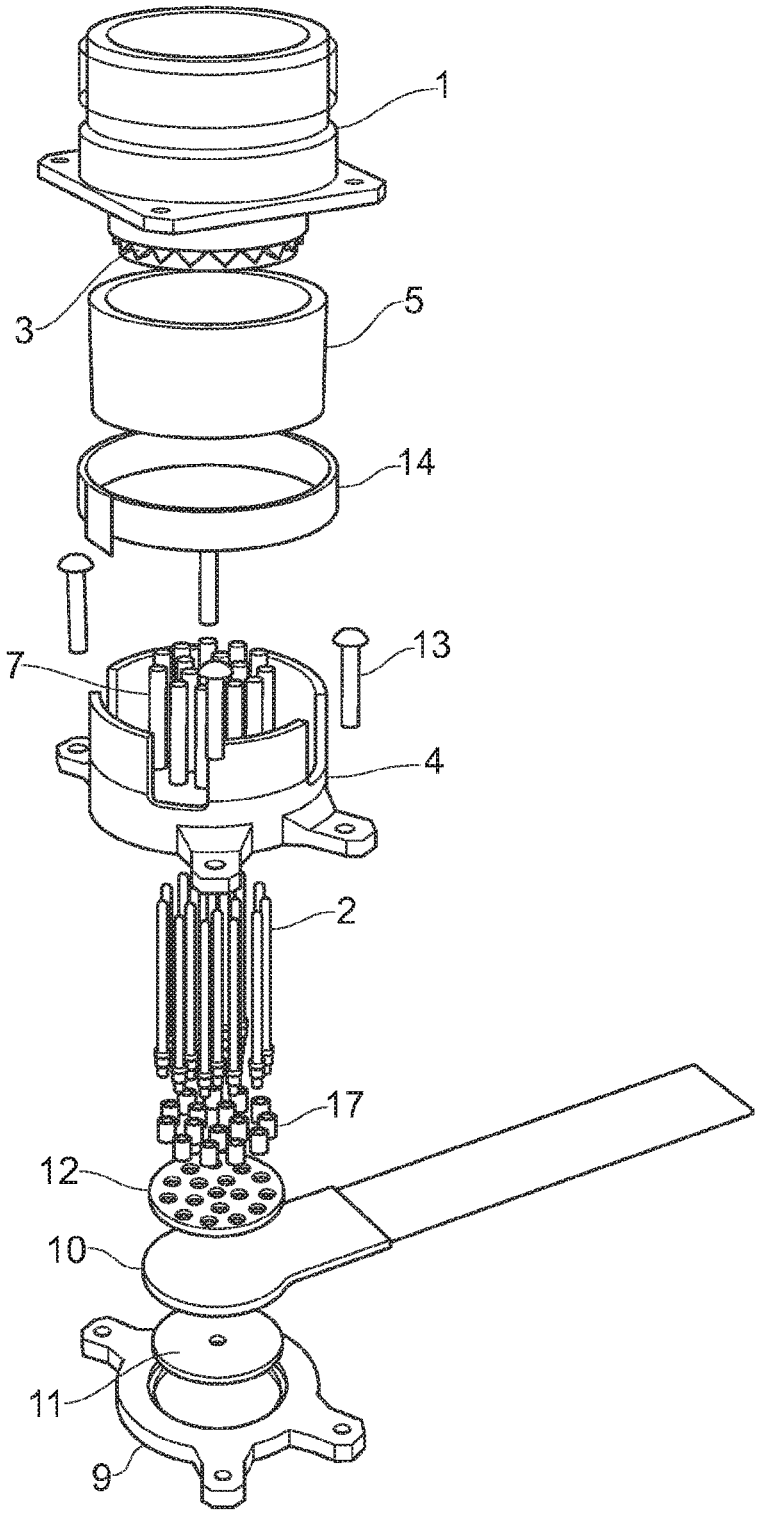
FIG. 1 shows an exploded view of a connector system with an interposer according to a first example.

While the present teachings are susceptible to various modifications and alternative forms, specific embodiments are shown by way of example in the drawings and are herein described in detail. It should be understood, however, that drawings and detailed description thereto are not intended to limit the scope to the particular form disclosed, but on the contrary, the scope is to cover all modifications, equivalents and alternatives falling within the spirit and scope defined by the appended claims.

As used in this specification, the words "comprises", "comprising", and similar words, are not to be interpreted in an exclusive or exhaustive sense. In other words, they are intended to mean "including, but not limited to".

It will be recognised that the features of the aspects of the invention(s) described herein can conveniently and interchangeably be used in any suitable combination. It will also be recognised that the invention covers not only individual embodiments but also combinations of the embodiments that have been discussed herein.

DETAILED DESCRIPTION

The present teaching relates generally to an interposer and a method of manufacturing of such an interposer.

An embodiment will be described in which the design of the interposer allows the termination of a standard aerospace electrical connector at termination pads or islands.

A further embodiment will be described in which the design of the interposer allows direct application of the interposer to the wing of an aircraft. The interposer of the present application is suitable for any application where termination is needed of conductors. For example, the interposer may be used in extreme environments such as: engines, pylons, empennages, fairings and landing gears. Furthermore, the interposer may be used in mild environments such as: inside the pressure cabin in the cargo bay, in the passenger compartment, and in avionics bays. The solution is adaptable, scalable and modular and can be used for signals as well as power.

Referring to FIG. 1, an exploded view of the electrical coupling of the first embodiment of the present application is shown.

Figure 2:
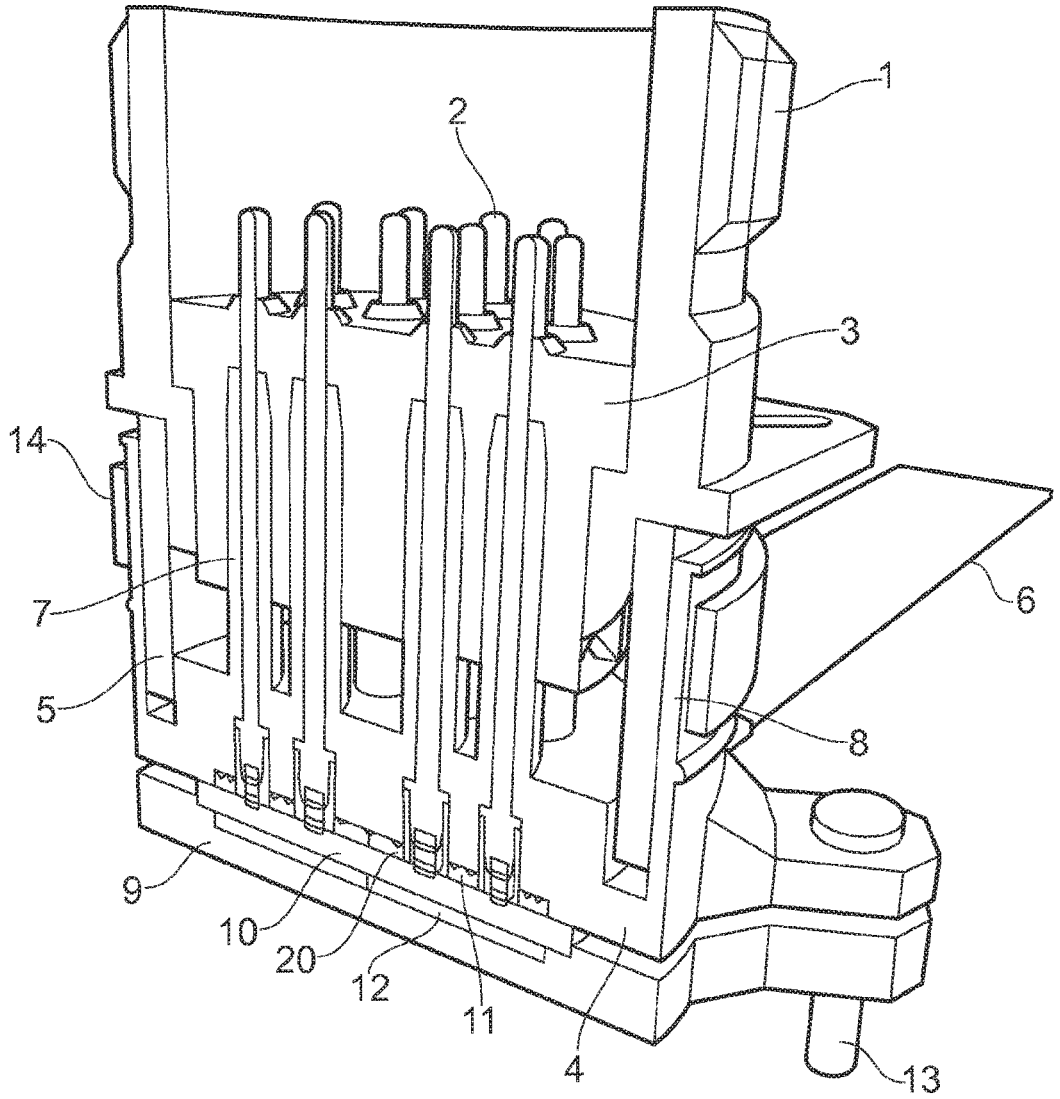
FIG. 2 shows a perspective view of a cut out of the connector system with the interposer according to a first example.

Referring to FIG. 2, from top to bottom of the drawing, a standard, off-the-shelf connector 1 is shown which includes contact cavities (not specifically shown) and a grommet seal 3 on the back. The grommet seal 3 is configured to prevent the ingress of moisture.

The outer surface of a first length of the connector 1 comprises accessory threading. A cylindrical interposer installation ring 5 is shown beneath the connector 1. In use, the interposer installation ring is configured to be connected to the connector 1 to provide a fluid or sand and dust barrier between the connector 1 and an interposer 4. Furthermore, the interposer installation ring allows for axial dimensional tolerances to ensure the correct length of the contacts extend through the connector. In the present example, the inner surface of the installation ring comprises threading, wherein the threading on the outer surface of the connector is configured to be received by and mate with the threading on the inner surface of the interposer installation ring 5. In other examples other means may be used to connect the interposer installation ring to the connector. For example, spacer screws and bolts, clamping/ratcheting arrangements or adhesive potting could be used.

In the present example, the interposer is made of an electrically insulating material. For example, the interposer may be made of any insulating thermoset or thermoplastic material. In the present example, the interposer body is made of one material and may be finished with a different material.

The interposer installation ring 5 is configured to be received by the interposer of the present application. The interposer has a peripheral wall 8. In the present example, the peripheral wall 4 is formed of four sections or clamping tabs such that, when viewed in an axial direction of the peripheral wall, an incomplete ring is formed. In other examples, more or fewer sections or clamping tabs may be used to form the incomplete circumferential ring.

In use, the interposer peripheral wall is arranged to surround the interposer installation ring 5. Once the interposer 4 is in position, a strap is positioned around the outside of the circumferential ring. The strap, once in position, is tightened to hold the interposer 4 in place. In use, the strap secures the interposer body on the interposer installation ring and prevents the adapter ring from unscrewing from the connector 1.

In the present example, the strap is made of metal, for example steel. In other examples, the strap may be made of other materials.

The interposer comprises a plurality of ducts 7 which extend from the main body of the interposer. Each duct has a through hole extending through the length of the duct.

Figure 3:
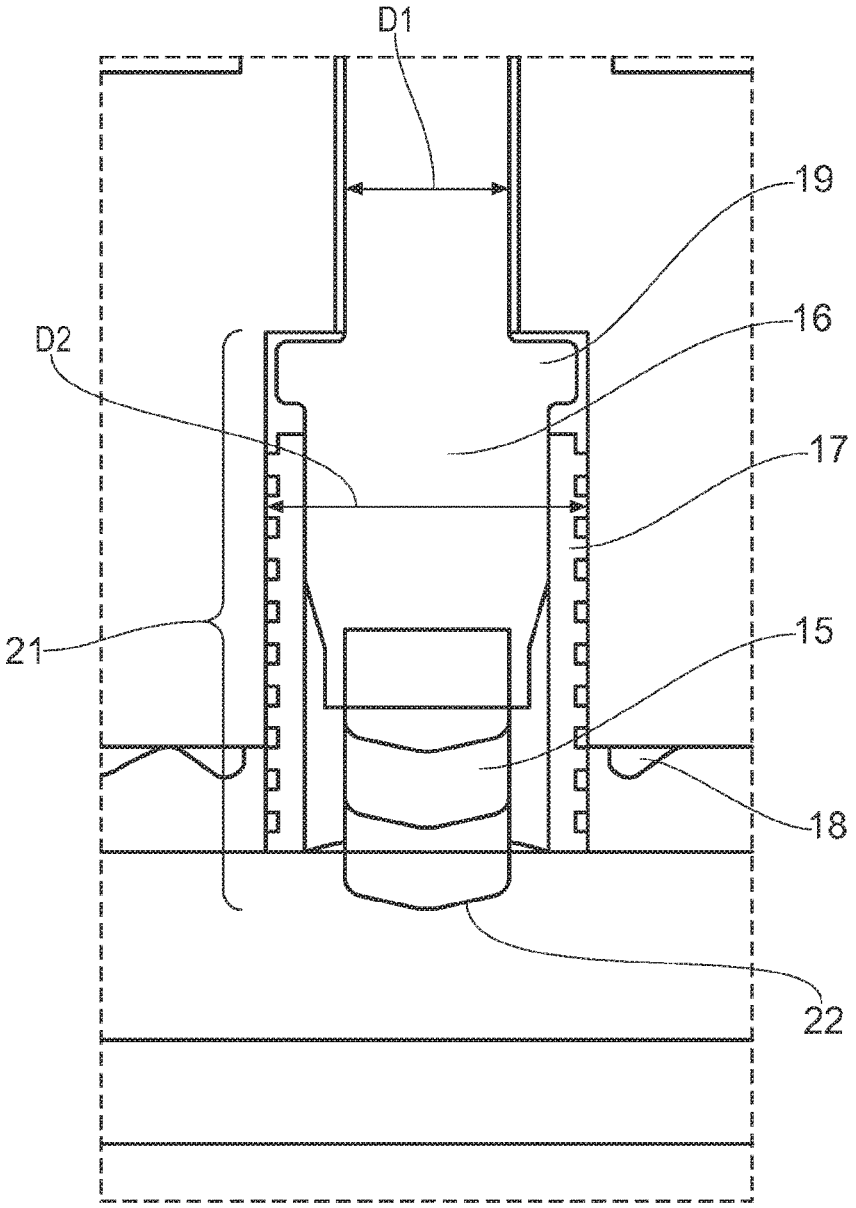
FIG. 3 shows an example end of a spring loaded contact.

The ducts extend parallel to the peripheral wall away from the main body of the interposer. The ducts have an external diameter which is sized to fit in the holes of the grommet seal. The interference between the outer surface of the ducts and the grommet seal ensures the ducts are sealed inside the connector. The connector has contact cavities which are configured to receive these ducts. The length of the ducts is chosen so that the end of each of the ducts reach the end of their respective contact cavity in the connector. This allows the contacts to protrude to the desired length to ensure a correct connection with a (to be) mated contra connector. When pin (male) contacts are used as is shown in FIGS. 1 to 3, the contacts also extend through the contact cavities and through an elastomer interfacial seal of the connector (not shown in the figures).

The height of the peripheral wall 8 is dimensioned such that the ducts of the interposer are able to extend to the desired amount into the grommet seal without the peripheral wall coming into contact with the connector when the peripheral wall is arranged around the interposer installation ring. For example, the height of the interposer peripheral wall is such that a sufficient surface is provided by which to clamp the wall to the connector with the strap whilst allowing insertion of the ducts into the grommet seal to the required extent.

Each duct is configured to receive an electrical contact 2. In the present example, the contacts are spaced from the inner surface of the ducts. This provides some freedom of movement to the contact to absorb small contact misalignments. In other examples, the inner surfaces of the ducts are in contact with the outer surface of the contacts. This results in a restricted movement of the contacts to prevent side loads on the contacts.

In the present example, the electrical contacts are spring loaded contacts. Each electrical contact comprises an elongate electrically conductive rod. Each electrical contact comprises a head wherein the head is situated at one end of the electrical contact. In use, the head of the electrical contact is located adjacent to an electrically conductive surface 20.

In the present example, the electrical contacts are gold plated for corrosion resistance and good electrical connection.

A contact retaining bushing 17 surrounds the head of the electrical contact when in use. The bushing is in place in order to retain the contact in its cavity during assembly or maintenance and to retain the elastomer seal during assembly.

In some examples, different types of contacts may be used in each duct. For example, normal contacts, or thermocouple contacts.

The electrical contact is configured to be brought into contact with an electrically conductive surface. In the present example, the electrically conductive surface is a surface of a PCB. In other examples the electrically conductive surface may be any mechanically stable surface such as a solid round conductor or conductive foil, tape or strip.

In the present example, a first elastomer seal 11 is positioned on the electrically conductive surface. The first elastomer seal 11 has holes extending through its depth which are configured to receive the heads of the electrical contacts. The first elastomer seal provides an environmental seal for the heads of the electrical contacts.

A PCB retaining cover is arranged to be attached to the end of the interposer. A second elastomer seal 12 lies between the PCB and the PCB retaining cover.

The interposer is configured to be attached to the PCB retaining cover by means of a connecting means 13. In the present example the connecting means is a bolt. In other examples, other forms of connecting means may be used.

In the present example, the connector comprises a square flange receptacle. In other examples this could be a jam-nut receptacle, box mount receptacle, a connector plug or any other connector variant.

In FIG. 2, a perspective cut out view of the assembled electrical coupling is shown. The electrical coupling shows the standard, off-the-shelf connector 1 connected to the interposer 4.

FIG. 2 shows the ducts 7 extending axially from the body of the interposer 4 and being received in the grommet seal 3. The electrical contacts are configured to extend through the through hole of the duct and beyond the open end of each duct through the connector contact cavity (not specifically shown in the picture) into the space within the cylindrical connector 1.

The interposer body has a first face from which the ducts extend and a second face which is configured to be brought into contact with the electrically conductive surface. The second face has a cavity which is configured to receive a first elastomer seal 11. In the present example, the cavity for receiving the first elastomer seal is circular and has a depth which is equal to or (slightly) larger than the thickness of the first elastomer seal.

The PCB retaining cover has a cavity which is configured to receive a second elastomer seal.

The cavity in the PCB retaining cover for receiving the first elastomer seal is circular. In the present example, the cavity has a stepped edge such that the depth of the cavity at the circumference of the cavity, a first depth, is less than the depth of the cavity at the centre of the cavity, a second depth. In this way a second cavity is formed within a first cavity wherein the second cavity is formed in the PCB retaining cover from a surface which is the first depth from the surface of the PCB retaining cover.

The thickness of the second elastomer seal is the same as or (slightly) less than a depth of the second cavity in the PCB retaining cover such that the second elastomer seal is fully received by the PCB retaining cover. In the present example, the second cavity additionally comprises a central protrusion extending from the base of the cavity and configured to be received by a centrally located hole in the second elastomer seal. In the present example, the height of the protrusion is the same as the depth of the second cavity. The protrusion is configured to hold the second elastomer seal in the desired location.

The elastomer seals provide environmental and cavity to cavity sealing in order to prevent electrical short circuits between the individual contacts. The elastomer seals also provide electrical isolation between individual contacts and the PCB and prevent moisture ingress to the PCB.

In the present example, the first cavity with the first depth is configured to receive the PCB 10. The PCB is thereby used as a hard stop to ensure controlled compression of the elastomer seals in order to obtain the desired seal integrity.

FIG. 3 shows an enlarged view of the head of the electrical contact when a spring loaded contact is used and is installed in the interposer. The head of the spring loaded contact comprises a shoulder 19. The head has a spring cavity 16 and a spring loaded pogo 15. In use, the spring loaded pogo is configured to absorb vibrations by being compressed and is received by the spring cavity when in compression. Furthermore, the use of spring loaded contacts provides a flexible termination to the PCB. When in its resting position, the spring loaded pogo is extended outside of the spring cavity.

Each duct has a through hole with a first diameter D1. Each through hole extends at least partially into the main body of the interposer. Each through hole is in communication with a second through hole with a second diameter D2, wherein the second diameter is larger than the first diameter. Each second through hole extends from the end of the first through hole to the second face of the interposer body.

Each second through hole is configured to receive a head of the electrical contacts. Retention bushing 17 surrounds the inner surface of the increased diameter through hole. This retains the contact and the elastomer seal during assembly and disassembly.

Interposer body ridges 18 extend from the body of the interposer into the first elastomer seal. Ridges in the interposer body ensure controlled seal compression and thereby seal performance whilst keeping the overall compression force low. In the present example, the ridges have a fluid 'wave-like' shape to prevent air pockets. Air pockets are undesirable because they may result in partial discharges when exposed to high electrical stress. Therefore, the ridges 18 are designed such that they cause the deformation of the seal without any voids being formed between the interposer and the seal.

The spring loaded pogo head is configured to contact with the electrically conductive surface of the PCB. The PCB may be formed with indentations to locate the heads of the contacts and prevent sideways movement of the contacts. This ensures alignment of the contacts with the PCB.

In some examples, the interposer may be rectangular in order to provide a connection with a standard rectangular electrical connector.

Figure 4:
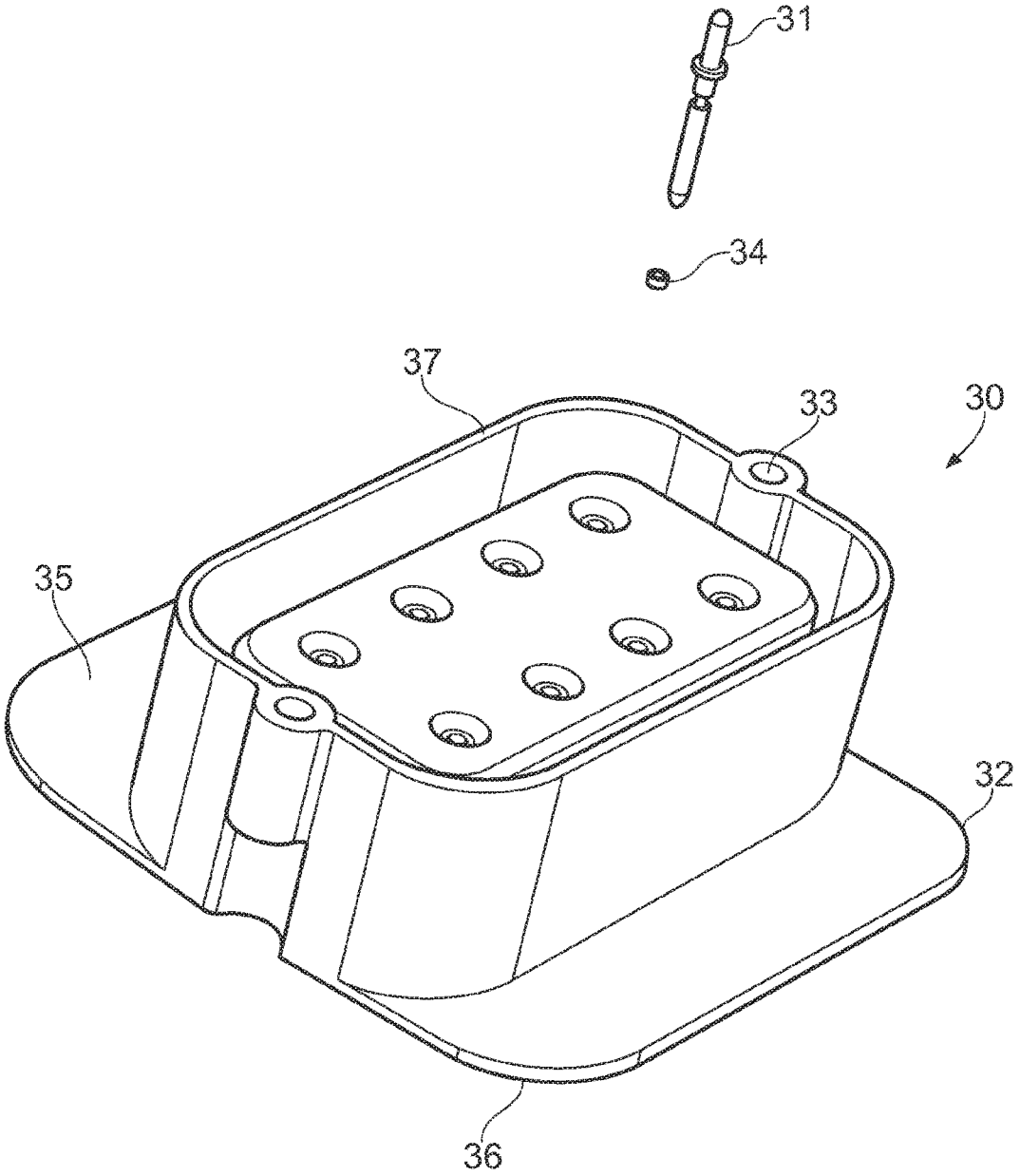
FIG. 4 is a perspective partly exploded view of an interposer according to a second example.

FIG. 4 shows an interposer combined with a connector interface according to a second embodiment. In the present example, the interposer according to the second embodiment is for use in the wing of an aircraft. The interposer may be used in any application where conductors embedded in a structure need to be terminated.

The connector 30 of the second aspect is configured to be laminated into a composite wing leading edge to become an integral part.

The connector 30 comprises a plurality of ducts 37 which are each configured to receive an electrical contact 31. In the present example 8 ducts are used. However, in other examples, more or less than 8 ducts maybe used. In each duct, an electrical contact 31 is installed. In the present example, the electrical contacts are spring loaded contacts. The spring loaded contacts comprise a pin connected to a pogo head.

FIG. 4 shows some of the ducts with a spring loaded contact within the duct and one of the spring loaded contacts in an exploded view. A locking spring clip 34 locks the contact in its cavity so that it cannot fall out or be pushed out by the pogo whilst ensuring compression of the pogo.

Figure 6:
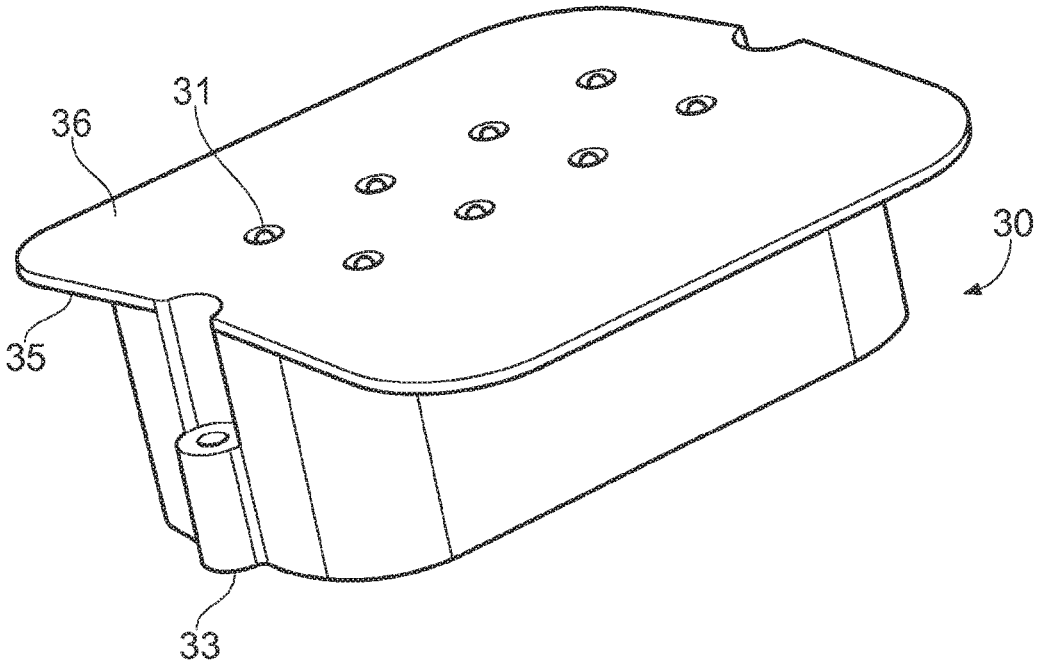
FIG. 6 is a further perspective view of the interposer from below according to the second example.

The interposer comprises an upper surface 35 and a lower surface 36. The lower surface of the interposer 30 comprises a flange 32. The flange 32 is laminated into the leading edge of an aircraft wing in order to integrate the connector with the leading edge structure. When in use and laminated into the aircraft wing, the flange will be captured in between layers of the composite lay-up. In the present example, the flanged lower surface of the interposer is curved such that, in use, the shape of the lower surface follows an internal contour of a wing of an aircraft. In use, the contacts are inserted from the front of the connector, i.e. the non curved side, so that the contacts can be installed after the leading edge is cured. The curved lower surface of the interposer is shown in FIG. 6.

Connector holes 33 extend from the upper surface of the interposer. The connector holes 33 include threaded inserts that accept bolts of a mating connector. These bolts will hold a mating connector plug (not shown in the drawings) in place.

Figure 5:
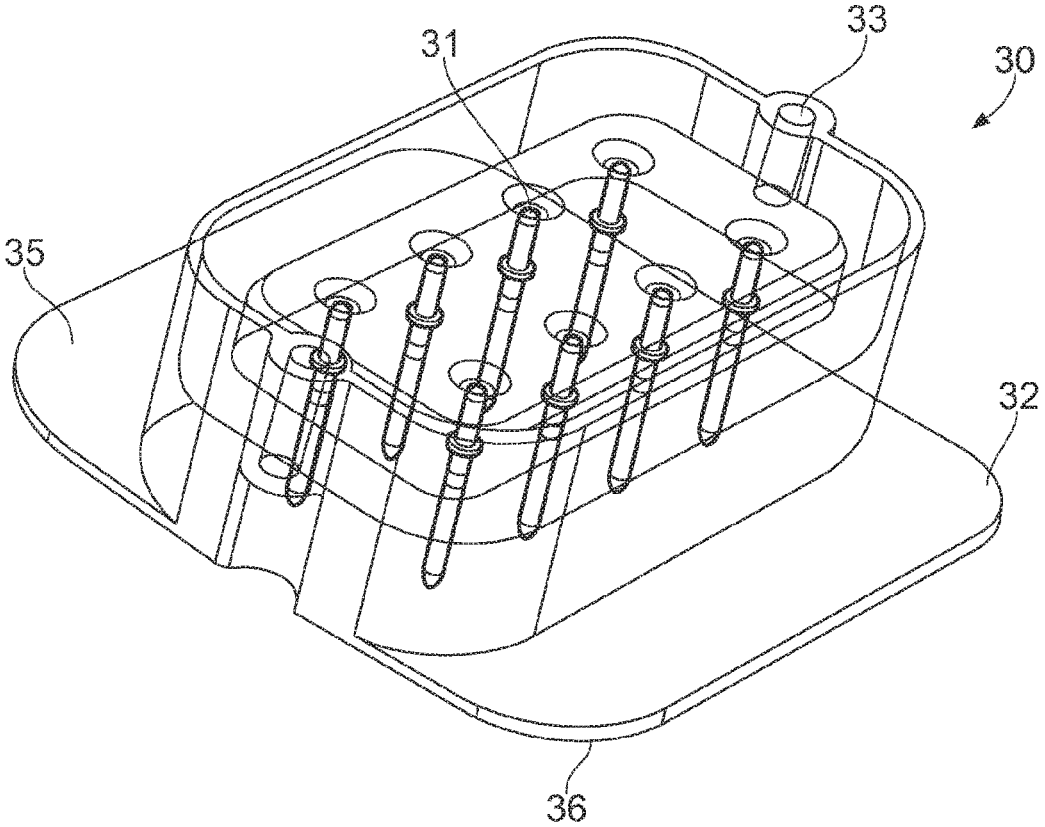
FIG. 5 is a perspective view of the interposer according to the example.

The module is shown in see-through form in FIG. 5 to illustrate the spring loaded contacts when they are installed in the interposer.

In some examples, the spring loaded contacts are inserted after the interposer has been installed. When installed, the spring loaded contacts are configured to land on busbars of the PCB.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the spirit and scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An electrical coupling, the coupling comprising:

an interposer arranged to electrically connect an electrical connector to an electrical circuit, the electrical connector comprising a plurality of electrical contacts and the electrical circuit comprising a plurality of electrical conductors, the interposer comprising a body arranged to surround each electrical contact at a portion of the body proximate to the electrical conductors, said body comprising a plurality of ducts each arranged around an electrical contact and configured to extend from the body along at least part of the length of each contact towards the electrical connector; and wherein the coupling further comprises a seal layer provided with a plurality of apertures each aperture aligning with a respective contact and wherein the seal layer is located at a portion of the body proximate to the electrical conductors.

2. The electrical coupling of claim 1, wherein the body and ducts are integral with each other.

3. The electrical coupling of claim 1, wherein each electrical contact comprises a biasing arrangement at a portion of the contact proximate to the electrical conductors, arranged to bias a distal end of the contact against a respective electrical conductor.

4. The electrical coupling of claim 3, wherein the biasing arrangement is a spring arranged to bias a distal portion of the contact towards a respective conductor.

5. The electrical coupling of claim 1, wherein each contact is an electrical conductor extending through the interposer and comprising a proximal end arranged for electrical contact with the electrical connector and a distal end arranged for electrical contact with an associated electrical conductor.

6. The electrical coupling of claim 1, wherein the electrical contacts and the ducts have a complementary shape.

7. The electrical coupling of claim 1, wherein inner surfaces of the ducts are in contact with outer surfaces of the contacts.

8. The electrical coupling of claim 1, wherein a length of each contact is longer than a distance measured between a portion of the electrical connector associated with a proximal portion of a respective contact and a surface of an electrical conductor associated with a distal portion of the respective contact.

9. The electrical coupling of claim 1, wherein the contacts are circular in cross-section and the ducts are arranged to surround each contact.

10. The electrical coupling of claim 1, wherein the interposer includes an electrically insulating material.

11. The electrical coupling of claim 1, wherein the interposer further comprises a peripheral wall surrounding and spaced from the ducts, said wall extending in a direction parallel with the ducts.

12. The electrical coupling of claim 11, wherein the peripheral wall is a ring surrounding the ducts and extending in a direction parallel with the ducts and further comprising a radial space between the ducts and the wall, said space arranged to receive a portion of the electrical connector.

13. The electrical coupling of claim 11, further comprising a peripheral ring arranged to surround a portion of the coupling adjacent to the peripheral wall, wherein the peripheral wall is integral with the body of the interposer.

14. The electrical coupling of claim 1, further comprising an end cap arranged to connect an end of the coupling and to define a cavity into which electrical conductors may extend, wherein the end cap further comprises the seal layer arranged to abut with a side of an electrical conductor layer opposite to a side against which the contacts abut.

15. An electrical coupling, the coupling comprising:

a body configured to be integrated with a surface wherein the body comprises a plurality of ducts arranged to align with corresponding connections of an electrical connector at a first end and to align with a plurality of electrical conductors at a second end;

wherein the conductors are integrated with the surface, the ducts extending through the body, wherein each duct comprises an electrical contact, each electrical contact comprising a biasing arrangement at a portion of the contact proximate to the electrical conductors, to bias a distal end of the contact against a respective electrical conductor; and wherein the coupling further comprises a seal layer provided with a plurality of apertures each aperture aligning with a respective contact and wherein the seal layer is located at a portion of the body proximate to the electrical conductors.

16. The electrical coupling of claim 15, wherein the biasing arrangement is a spring arranged to bias a distal portion of the contact towards a respective conductor.

17. The electrical coupling of claim 15, wherein a face of the body proximate to the electrical conductors comprises a convex profile corresponding to a predetermined curvature.

18. The electrical coupling of claim 17, wherein the face of the body proximate to the electrical conductors further comprises a peripheral flange extending from the body for attachment to a structure.

19. The electrical coupling of claim 18, wherein the flange and/or body are formed from a composite material.

* * * * *